US006458857B1

(12) United States Patent
Wittenbrink et al.

(10) Patent No.: US 6,458,857 B1
(45) Date of Patent: Oct. 1, 2002

(54) PROCESS FOR MAXIMIZING 371° C.+ PRODUCTION IN FISCHER-TROPSCH PROCESS

(75) Inventors: Robert Jay Wittenbrink, Kingwood, TX (US); Louis Francis Burns, Baton Rouge, LA (US); Gregg Johnston Howsmon, Baton Rouge, LA (US); Geoffrey Rhys Say, Baton Rouge, LA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

(21) Appl. No.: 09/996,416

(22) Filed: Nov. 20, 2001

(51) Int. Cl.[7] ..... C07C 27/00

(52) U.S. Cl. ..... 518/715; 518/700; 518/705; 518/712; 518/715

(58) Field of Search ..... 518/700, 705, 518/712, 715

(56) References Cited

U.S. PATENT DOCUMENTS 5,140,050 A * 8/1992 Mauldin et al. ..... 518/715
5,545,674 A * 8/1996 Behrmann et al. ..... 518/715

* cited by examiner

*Primary Examiner*—Jafar Parsa
(74) *Attorney, Agent, or Firm*—Jay S. Simon

(57) ABSTRACT

A hydrocarbon synthesis (HCS) process wherein a Fischer-Tropsch reactor is operated to maximize the selectivity to 371° C.+ boiling fraction while minimizing the production of less valuable products such as light gases ($C_1$–$C_4$), naphtha and diesel fractions. Inventive modes of operation to offset the effects of catalyst deactivation and maximize selectivity to 371° C.+ boiling fraction are utilized including (a) reducing gas inlet velocity to maintain an optimal CO conversion level, (b) introducing additional active catalyst until a maximum loading is reached, and (c) increasing reactor temperature until productivity reaches a predetermined cut-off level.

14 Claims, No Drawings

PROCESS FOR MAXIMIZING 371° C.+ PRODUCTION IN FISCHER-TROPSCH PROCESS

FIELD OF THE INVENTION

The present invention relates to the production of hydrocarbon products from a hydrocarbon synthesis (HCS) reaction. More particularly, the invention relates to a process for maximizing the production of hydrocarbons boiling above 371° C. in a Fischer-Tropsch synthesis process.

BACKGROUND OF THE INVENTION

The catalytic production of higher hydrocarbon materials from synthesis gas, i.e. carbon monoxide and hydrogen, represented by the equation $2H_2+CO \rightarrow —(CH_2)— + H_2O$, commonly known as the Fischer-Tropsch process, has been in commercial use for many years. The hydrocarbon product of a typical Fischer-Tropsch process includes a wide variety of chemical components including oxygenates, olefins, esters, and paraffins, much of which can be gaseous or liquid at reaction conditions. These Fischer-Tropsch products have benefits over those obtained via traditional refining processes in that the material is essentially free of sulfur, metals, nitrogen-containing compounds and aromatics.

The Fischer-Tropsch process depends on specialized catalysts. The original catalysts for Fischer-Tropsch synthesis were typically Group VIII metals, particularly cobalt and iron, which have been adopted in the process throughout the years to produce higher hydrocarbons. As the technology developed, these catalysts became more refined and were augmented by other metals that function to promote their activity as catalysts. Such promoter metals include the Group VIII metals, such as platinum, palladium, ruthenium, and iridium, other transition metals such as rhenium and hafnium as well as alkali metals. Preferred Fischer-Tropsch catalysts are supported on an inorganic refractory oxide selected from Groups III, IV, V, VI, and VIII of the Periodic Chart. Preferred supports include silica, alumina, silica-alumina, the Group IVB oxides, most preferably titania, such as those disclosed, e.g. in U.S. Pat. No. 5,128,377.

The choice of a particular metal or alloy for fabricating a catalyst to be utilized in Fischer-Tropsch synthesis will depend in large measure on the desired product or products. The more valuable product fractions lie in the heavy paraffinic wax range, more specifically in those products boiling above 371° C. (typically referred to as 371° C.+ products). Generally, the wax obtained from the Fischer-Tropsch process is catalytically converted to lower boiling paraffinic hydrocarbons falling within the gasoline and middle distillate boiling ranges, primarily by hydrogen treatments, e.g. hydrotreating, hydroisomerization and hydrocracking. Additionally, as new markets for high quality waxes have expanded, the Fischer-Tropsch wax itself has increased in value as an end product.

Catalyst deactivation of Fischer-Tropsch catalyst is a long-standing problem known to have a deleterious effect on commercial productivity particularly in a high activity catalyst. Catalyst deactivation occurs for a variety of reasons, most notably sulfur poisoning due to small amounts of sulfur which may contaminate synthesis gas produced from natural gas, but can also occur due to sintering of the metal particles or coke formation as well as several other mechanisms. As catalyst activity declines, so does reactor productivity. Productivity is defined as the standard volume of carbon monoxide converted/volume catalyst/hour and can be expressed as %CO conversion. As catalyst activity declines, %CO conversion declines assuming all other reaction variables, e.g. temperature, gas hourly space velocity (GHSV) are held constant. This holds true for all reactor types.

To offset catalyst deactivation, production plants typically switch to a Temperature Increase Required (TIR) mode, whereby the synthesis gas feed rate is kept constant and reactor temperature is increased in order to maintain constant CO conversion at an optimal level. However, increasing reaction temperature to maintain productivity levels leads to a corresponding increase in methane selectivity and a decrease in the production of more valuable liquid hydrocarbons. Thus, in a TIR mode, as the rate of reaction is increased by operating at higher temperatures, methane formation is favored. This is an unfavorable result as methane is not a desired product. In addition, the production of methane is accompanied by a shift in the entire product slate to lower boiling materials, particularly $C_1$–$C_4$ gases and naphtha, at the expense of higher boiling, more valuable liquid products, such as diesel and waxes.

Thus, while high productivities are desirable in commercial operations, it is essential that high productivity be achieved without high methane formation, because high methane production results in lower production of more valuable higher liquid hydrocarbons. Despite advancements in the development of selective high activity catalysts which are capable of high productivity combined with low methane selectivity, there remains a need for improved gas conversion processes that overcome catalyst deactivation and achieve still higher productivity while favoring the production higher value liquid hydrocarbon products, preferably $C_{10}$ +, more preferably those boiling above 371° C.

Accordingly, the present invention provides a process for the preferential conversion of synthesis gas to liquid hydrocarbon products that combines high productivity with low methane selectivity.

SUMMARY OF THE INVENTION

In one embodiment of this invention, a Fischer Tropsch reactor is operated under process conditions maximizing the production of valuable heavy wax products while minimizing the production of less valuable products such as light gases ($C_1$–$C_4$ ) and naphtha fractions. The process is characterized by high $C_{10}$+ selectivity, preferably high $C_{19}$+ selectivity, resulting in the preferential production of material boiling above 371° C.

Thus, a hydrocarbon synthesis process is provided which comprises the steps of a) reacting carbon monoxide with hydrogen in a Fischer-Tropsch reactor in the presence of active Fischer-Tropsch hydrocarbon synthesis catalyst to induce a hydrocarbon synthesis reaction with a predetermined methane selectivity under initial reaction conditions comprising an initial synthesis gas feed rate ($F_i$) and an initial reaction temperature ($T_i$) wherein the initial reaction conditions are selected to achieve a target %CO conversion; and, b) thereafter adjusting the synthesis gas feed rate over time to maintain the target %CO conversion at the initial reaction temperature ($T_i$) by decreasing the synthesis gas feed rate from the initial synthesis gas feed rate to a predetermined minimum synthesis gas feed rate ($F_{min}$). Optionally thereafter, the temperature may be adjusted as necessary to maintain the target %CO conversion at the minimum synthesis gas feed rate ($F_{min}$) by increasing reaction temperature from the initial reaction temperature to a maximum final temperature $T_{max}$. The maximum final temperature is the temperature at which methane selectivity reaches a predetermined maximum level.

In other embodiments, at any time during the hydrocarbon synthesis process, a portion of the catalyst which has been at least partially deactivated may optionally be removed from the reactor, treated to restore catalyst activity and re-introduced into the reactor as fresh catalyst.

In another embodiment, additional active catalyst may be introduced, up to a maximum catalyst loading, prior to decreasing the synthesis gas feed rate to prolong maintenance of the target %CO conversion at the initial reaction conditions.

DETAILED DESCRIPTION OF THE INVENTION

The Fischer-Tropsch hydrocarbon synthesis process can produce a wide variety of materials depending on catalyst and process conditions. Much research has focused on the development of selective catalysts which are capable of high liquid hydrocarbon selectivity combined with low methane selectivity. However, catalyst deactivation, particularly with a high activity catalyst, has a detrimental effect on commercial productivity. In the present invention, novel process modes offset the effects of catalyst deactivation, maintaining high productivity with low methane selectivity thus favoring the production of high value liquid products and improving overall efficiency. The inventive process is characterized by high productivity and high selectivity to $C_{10}$+ hydrocarbons, resulting in a greater proportion of high value products boiling in the 371° C.+ range.

As described herein, a Fischer Tropsch reaction is initiated under process conditions comprising an initial reaction temperature and an initial synthesis gas feed rate that are selected to maximize the production of 371° C.+ boiling fraction materials while minimizing the production of less valuable products such as light gases ($C_1$–$C_4$) and naphtha fractions. These initial optimal reaction conditions are adjusted as needed over time to maintain optimal productivity and high hydrocarbon liquid selectivity. To offset the drop in productivity due to catalyst deactivation, gas inlet velocity is reduced while holding temperature constant to maintain productivity levels. Reduction of gas inlet velocity may then be followed by operating the reactor at a higher temperature to further maintain productivity, the higher temperature being selected to optimize liquid hydrocarbon selectivity to the extent possible until productivity falls to a predetermined cutoff level. These operative modes may optionally be combined with the introduction of fresh catalyst to aid in offsetting catalyst deactivation.

The Fischer-Tropsch hydrocarbon synthesis processes of the invention may be carried out in a slurry mode or a fixed bed mode. Fischer-Tropsch processes which benefit from the present invention are preferably those in which the reactor is operated in a slurry mode. In a slurry mode, catalyst is suspended and freely moving, as opposed to a fixed bed mode where the catalyst is spatially static. Preferred slurry-type processes may be carried out, e.g. in moving bed systems or slurry reactors. The slurry comprises slurry liquid and finely divided catalyst, wherein the catalyst particles are suspended in a liquid hydrocarbon and the CO/hydrogen mixture is forced there through allowing good contact between the CO/hydrogen and the catalyst to initiate and maintain the hydrocarbon synthesis process.

Advantages of slurry-type processes over fixed bed processes include better control of the exothermic heat produced in the Fischer-Tropsch process during the reaction and better control over catalyst activity maintenance by allowing recycle, recovery, and rejuvenation procedures to be implemented. The slurry process can be operated in a batch mode or in a continuous cycle. In a continuous cycle, the entire slurry can be circulated in the system allowing for better control of the primary products' residence time in the reaction zone.

Slurry reactors are well known for carrying out highly exothermic, three phase slurry-type Fischer-Tropsch reactions. Reactors in which such three phase hydrocarbon synthesis processes are carried out are sometimes referred to as "bubble columns", and are disclosed, for example, in U.S. Pat. No. 5,348,982. In such three-phase hydrocarbon synthesis (HCS) processes, a synthesis gas (syngas) comprising a mixture of $H_2$ and CO is bubbled up as a third phase through a slurry in the reactor in which the slurry comprises liquid hydrocarbons and dispersed solid catalyst particles. The catalyst may be suspended in the reactor by mechanical agitation, natural dispersive forces, buoyancy driven flow, forced convection or any combination thereof The liquid phase of the slurry typically comprises an admixture of the hydrocarbon products of the Fischer-Tropsch reaction. A particularly notable feature of a slurry reactor is that catalyst and/or liquid may be added and catalyst/liquid may also be withdrawn during synthesis while the reactor is running.

The catalysts utilized in the present invention can be either bulk catalysts or supported catalysts. The catalyst is typically a metal catalyst, preferably Co, Ru or Fe or other Group VIII metal, most preferably cobalt, on an oxide support, e.g. silica, titania, alumina, etc. Cobalt is a preferred catalytic metal in that it is desirable for the purposes of the present invention to start with a process designed to produce a Fischer-Tropsch wax product with a relatively high proportion of linear $C_{10}$ + paraffins. The catalyst can and often does contain promoters such as Re, Pt, Zr, Hf etc.

In one embodiment of the present invention process, a slurry bubble column reactor is loaded with an active Fischer-Tropsch catalyst selected to facilitate the desired productivity and selectivity to liquid hydrocarbons. A preferred catalyst is a cobalt-containing catalyst. The hydrocarbon synthesis reaction is then conducted in the Fischer Tropsch reactor at pressures from about 150 to 700 psia. In the initial operative mode, reaction conditions comprising an initial synthesis gas feed rate and an initial reaction temperature are selected to induce the Fischer-Tropsch reaction to achieve a target %CO conversion.

The target %CO conversion is selected to achieve a methane selectivity that optimizes the production of liquid hydrocarbons for the particular catalyst selected. Preferred target CO conversion rates may range from about 20 to 98%, more preferably about 50 to 95%, most preferably about 70 to 90%. The initial feed gas rate ($F_1$) preferably comprises a superficial linear velocity from about 10 to 50 cm/sec, more preferably from about 15 to 35 cm/sec and most preferably from about 17 to 30 cm/sec. The initial Fischer-Tropsch reaction temperature is a moderately low temperature for the particular catalyst selected, preferably about 180–220° C., more preferably about 195–215° C., most preferably about 200–210° C. These moderately low reaction temperatures give rise to a greater 371° C.+ selectivity with lower methane selectivity than would be achieved with higher temperatures.

After a period of time, as the reaction progresses and the catalyst degrades, the process is no longer capable of maintaining the target %CO conversion under the initial reaction conditions and the reactor is switched to a second operative mode. In the second operative mode, the reactor feed rate is gradually decreased in order to maintain the target %CO conversion while the reactor temperature is held at the initial reaction temperature. This maintains liquid hydrocarbon selectivity at the initially high levels, unlike prior art processes operating in a TIR mode that switch to a higher temperature at this point to overcome the effects of catalyst deactivation. In this second operative mode, the decreasing syngas feed rate approaches a preset minimum value (preferably no less than about 7.0 cm/sec) and the catalyst continues to deactivate. Again, as the reaction progresses, after a period of time, the process is no longer capable of maintaining the target %CO conversion and the second operating mode ceases to be economically attractive.

At this point, the reactor may be switched to a third operating mode. In the third operating mode, the reactor temperature is increased to maintain the target % CO conversion up to a predetermined maximum final temperature wherein the final temperature is the temperature at which methane selectivity reaches a predetermined cutoff level. In preferred embodiments, the maximum final temperature is about 232° C., more preferably about 227° C., most preferably about 221° C. The reactor is operated in the third mode until productivity falls to a predetermined cut-off level.

At any time during the process, catalyst and liquid hydrocarbon product may be removed from the reactor and the catalyst separated from the liquid hydrocarbon, leaving dry, deactivated catalyst. This deactivated catalyst may then be treated by methods known in the art to restore it to a fresh state where the catalyst activity is similar to its initial activity. Catalyst thus restored may be re-introduced into the process as active catalyst.

In an another embodiment, if maximum catalyst loading has not been reached at the outset, additional active catalyst may be introduced to the operating reactor to offset catalyst deactivation prior to decreasing the reactor feed rate to prolong maintenance of the target %CO conversion at the initial reaction conditions. Here again the selectivity to higher molecular weight products remains at initial high levels.

The following non-limiting Examples further illustrate the invention.

EXAMPLE 1

Operation of a pilot scale bubble column Reactor at moderate to high reactor temperature Example 1 illustrates process conditions and product yields during operation of a bubble column reactor in which temperature was increased during the run in accordance with a typical TIR protocol. The bubble column reactor was a six-inch nominal diameter bubble column. The hydrocarbon synthesis reaction in the Fischer Tropsch reactor was conducted at about 290 psia outlet pressure. Synthesis feed gas comprising a mixture of hydrogen and carbon monoxide was introduced into the reactor at a linear velocity of about 17 cm/sec. The $H_2$:CO molar ratio was 2.09. During the 90 day run, the CO conversion (amount of CO converted to hydrocarbon products) was maintained at about 40–50% by increasing reactor temperature from 211° C. to 221° C. Methane selectivity (amount of methane produced per amount of CO converted) increased from about 5% at the beginning of the period to over 8.5% by the end of 90 days of operation. Correspondingly, the heavy hydrocarbon liquid yield of 371° C.+ boiling fraction decreased substantially, falling from 41.4% (weight of 371° C.+ boiling fraction/amount of CO converted) to 26.9% as shown in Table 1.

TABLE 1

OPERATION OF A PILOT SCALE BUBBLE COLUMN REACTOR AT MODERATE TO HIGH REACTOR TEMPERATURE (TIR MODE)

| | | | | | |
|---|---|---|---|---|---|
| Days on Syngas (d) | 7.22 | 9.32 | 44.32 | 70.36 | 80.40 |
| Inlet Superficial Velocity (cm/sec) | 17.1 | 17.0 | 17.0 | 17.3 | 17.5 |
| CO Conversion (%) | 49.85 | 49.58 | 42.89 | 48.55 | 42.67 |
| CH4 Selectivity (%) | 4.99 | 4.97 | 5.98 | 7.39 | 8.52 |
| Gas Hourly Space Velocity (1/hr) | 11680 | 11620.727 | 11758 | 11774 | 12061 |
| Reactor Temp (° C.) | 211 | 211 | 211 | 221 | 221 |
| Boiling Point Distributions in Weight Percent | | | | | |
| C1 | 5.58% | 5.52% | 6.49% | 8.13% | 9.37% |
| C2 | 0.63% | 0.60% | 0.58% | 0.68% | 0.77% |
| C3–C4 | 4.88% | 4.82% | 4.47% | 4.84% | 5.54% |
| C5-160° C. | 16.54% | 16.03% | 15.75% | 19.12% | 21.20% |
| 160–260° C. | 12.55% | 12.14% | 13.23% | 12.49% | 15.97% |
| 260–371° C. | 18.46% | 18.98% | 19.74% | 20.84% | 20.17% |
| 371–454° C. | 14.65% | 14.94% | 15.40% | 15.01% | 13.25% |
| 454–566° C. | 17.26% | 16.80% | 17.08% | 14.08% | 11.03% |
| 566° C.+ | 9.45% | 10.18% | 7.25% | 4.80% | 2.69% |
| Total | 100.00% | 100.00% | 100.00% | 100.00% | 100.00% |
| 371° + % Total | 41.36% | 41.92% | 39.73% | 33.90% | 26.97% |
| 371° + % $C_5$+ | 46.52% | 47.07% | 44.80% | 39.25% | 32.00% |

EXAMPLE 2

Operation of a Pilot Scale Bubble Column Reactor at Low Reactor Temperature with Decreasing Gas Feed Rate Example 2 illustrates process conditions and product yields during operation of bubble column reactor in accordance with the present invention in which the reactor temperature was held relatively constant at about 210° C. and the linear velocity syngas feed gas rate was varied. The bubble column reactor was the same reactor as described in Example 1. The reaction was conducted at about 425 psia outlet pressure. Feed gas comprising a mixture of carbon monoxide and hydrogen was introduced into the reactor at a linear velocity of 17.5 cm/sec. The $H_2$:CO ratio was 2.13. During the 150 day run, the CO conversion was maintained between 70 and 85% by decreasing feed inlet velocity from 17.5 cm/sec. to 8.3 cm/sec. Methane selectivity remained relatively constant at an average value of about 4.5% over the 150 day period. Correspondingly, the heavy hydrocarbon liquid yield of 371° C.+ boiling fraction remained relatively constant as well averaging about 45.9% as shown in Table 2.

TABLE 2

OPERATION OF A PILOT SCALE BUBBLE COLUMN REACTOR AT LOW REACTOR TEMPERATURE WITH DECREASING GAS FEED RATE

| Days on Syngas (d) | 14.47 | 25.47 | 37.47 | 64.67 | 91.47 | 115.47 | 151.47 |
|---|---|---|---|---|---|---|---|
| Inlet Superficial Velocity (cm/sec) | 17.5 | 17.4 | 17.3 | 13.8 | 11 | 8.3 | 8.3 |
| CO Conversion (%) | 80.49 | 83.92 | 80.92 | 80.53 | 74.44 | 74.17 | 69.08 |
| CH4 Selectivity (%) | 4.44 | 4.46 | 4.58 | 4.65 | 5.22 | 3.48 | 4.28 |
| Gas Hourly Space Velocity (1/hr) | 10080 | 10165 | 10130 | 8152 | 6643 | 4821 | 4776 |
| Reactor Temp (° C.) | 210 | 210 | 210 | 210 | 210 | 210 | 210 |
| | | Boiling Point Distributions in Weight Percent | | | | | |
| C1 | 5.20% | 4.69% | 4.80% | 5.78% | 5.53% | 4.45% | 4.96% |
| C2 | 0.47% | 0.38% | 0.35% | 0.46% | 0.44% | 1.14% | 1.34% |
| C3–C4 | 3.90% | 4.50% | 3.04% | 3.71% | 3.43% | 8.54% | 8.93% |
| C5-160° C. | 18.26% | 15.65% | 17.24% | 18.43% | 14.15% | 20.83% | 21.77% |
| 160–260° C. | 9.15% | 10.09% | 9.78% | 10.11% | 9.77% | 7.09% | 8.08% |
| 260–371° C. | 17.81% | 17.41% | 17.82% | 14.89% | 16.49% | 14.21% | 13.00% |
| 371–454° C. | 16.07% | 15.82% | 15.88% | 15.40% | 15.82% | 13.42% | 12.09% |
| 454–566° C. | 19.03% | 19.48% | 19.43% | 19.89% | 20.18% | 18.14% | 16.02% |
| 566 C.°+ | 10.10% | 11.97% | 11.65% | 11.33% | 14.19% | 12.18% | 13.80% |
| Total | 100.00% | 100.00% | 100.00% | 100.00% | 100.00% | 100.00% | 100.00% |
| 371° C.+ % Total | 45.21% | 47.27% | 46.96% | 46.62% | 50.18% | 43.74% | 41.92% |
| 371° C.+ % $C_5$+ | 50.00% | 52.27% | 51.10% | 51.77% | 55.38% | 50.93% | 49.45% |

The results show that the 371° C.+ selectivity was significantly increased by operating the reactor according to the present invention process. While operating in a conventional TIR Mode, as the overall 371° C.+ product yield fell over the 90 day run from 41.4% to 26.9%, the proportion of total $C_5$+ product represented by the 371° C.+ fraction also fell from 46.5% to 32.0%. While operating according to the present invention process, overall 371° C.+ product yield ranged from 45.2% to 50.2% over the first 90 days of the 150 day run representing a vast improvement over the TIR method. The yield then gradually fell to a final level of 41.9% at the end of the run which was comparable to the highest initial levels achieved in the TIR mode. Moreover, under the present invention process conditions, the 371° C.+ fraction ranged from 49.5% to 55.4% of the total $C_5$+ product throughout the 150 day run.

What is claimed is:

1. A process useful for the conversion of synthesis gas to liquid hydrocarbons, which comprises:

a) reacting carbon monoxide with hydrogen in the presence of a Fischer-Tropsch hydrocarbon synthesis catalyst to induce a hydrocarbon synthesis reaction with a methane selectivity no greater than a pre-determined level under reaction conditions comprising an initial reaction temperature and an initial synthesis gas feed rate, said initial reaction conditions selected to achieve a pre-determined target %CO conversion ±5%; and, b) thereafter gradually decreasing said synthesis gas feed rate over time to a predetermined minimum synthesis gas feed rate and maintaining said target %CO conversion.

2. The process of claim 1 wherein said target %CO conversion is selected such that at least 50% by weight of the total $C_5$+ product of said hydrocarbon synthesis reaction is a 371° C. + product.

3. The process of claim 2 wherein said initial reaction temperature is from about 190° C. to about 210° C.

4. The process of claim 3 wherein said target %CO conversion is from about 50% to about 95%.

5. The process of claim 4 wherein said predetermined target %CO conversion is from about 70% to about 90%.

6. The process of claim 1 wherein said initial synthesis gas feed rate is from about 17 to about 30 cm/sec and said minimum synthesis gas feed rate is from about 7 to about 8.5 cm/sec.

7. The process of claim 1 further including the step of, increasing said reaction temperature after step b) to a final reaction temperature to maintain said target %CO conversion at said minimum synthesis gas feed rate, wherein said final reaction temperature is a temperature at which said methane selectivity is no more than a predetermined maximum level.

8. The process of claim 7 wherein said final reaction temperature is from about 221° C. to about 232° C.

9. The process of claim 1 further including the step of introducing additional active catalyst into said reactor prior to step b) up to a maximum catalyst loading amount to prolong maintenance of said target %CO conversion under said initial reaction conditions.

10. The process of claim 1 wherein during said hydrocarbon synthesis reaction, at least a portion of said hydrocarbon synthesis catalyst which has been at least partially deactivated is removed from said reactor, treated to restore catalyst activity and re-introduced as active catalyst into said reactor.

11. The process of claim 1 wherein said catalyst comprises at least one supported Group VIII metal.

12. The process of claim 11 wherein said metal comprises cobalt.

13. The process of claim 12 wherein said support comprises titania.

14. The process of claim 7 wherein said catalyst comprises at least one supported Group VIII metal.

* * * * *